US005562409A

United States Patent [19]

Livsey et al.

[11] Patent Number: 5,562,409

[45] Date of Patent: Oct. 8, 1996

[54] AIR COOLED GAS TURBINE AEROFOIL

[75] Inventors: Duncan J. Livsey, Burton-on-Trent; Martin Hamblett, Derby, both of England

[73] Assignee: Rolls-Royce plc, London, England

[21] Appl. No.: 820,268

[22] Filed: Nov. 27, 1985

[30] Foreign Application Priority Data

Dec. 1, 1984 [GB] United Kingdom ..... 8430378

[51] Int. Cl.[6] ..... F01D 5/18

[52] U.S. Cl. ..... 415/175; 415/115; 416/96 R; 416/95

[58] Field of Search ..... 415/175, 114, 415/115, 116, 117; 416/92, 96 R, 97 R, 96 A, 232

[56] References Cited

U.S. PATENT DOCUMENTS

| | | | |
|---|---|---|---|
| 2,991,973 | 7/1961 | Cole | 416/97 R |
| 4,529,357 | 7/1985 | Holland | 416/97 R |
| 4,650,399 | 3/1987 | Craig et al. | 416/97 R |
| 5,151,012 | 9/1992 | Hough | 416/95 |
| 5,201,634 | 4/1993 | Hough | 416/96 R |

*Primary Examiner*—Michael J. Carone
*Assistant Examiner*—Christopher K. Montgomery
*Attorney, Agent, or Firm*—Cushman Darby & Cushman, L.L.P.

[57] ABSTRACT

A hollow turbine blade has cooling air feed passages in the wall defining the central cavity. The wall surfaces of the feed passages slope away from the central cavity in a diverging manner, so as to reduce the step difference in metal thickness between the passages relative to the thickness of metal dividing each passage and the central cavity. The temperature gradient from the blade external surface and the wall surface of the central cavity is thus also reduced, avoiding thermal stresses.

2 Claims, 2 Drawing Sheets

AIR COOLED GAS TURBINE AEROFOIL

This invention relates to air cooled aerofoils ie, turbine blades and guide vanes, of the kind utilised in gas turbine engines.

It is well known, to pass cooling air through turbine blades and guide vanes during operation of the gas turbine engine in which they are situated. By such means is the metal from which the blade and/or vane is made, able to withstand operating temperatures which would otherwise destroy the blade and/or vane in an unacceptably short time.

Such application of cooling air however, does generate thermal gradients across the metal thickness, which in turn generate stresses which in some operating environments, proves detrimental to the overall resistive capacity of the blade and/or vane to working stresses.

The present invention seeks to provide an improved, air cooled turbine aerofoil and/or guide vane.

According to -the present invention an aerofoil blade or vane as hereinbefore defined comprises a central cavity extending lengthwise of the aerofoil and further, relatively narrow cavities situated in the walls bounding the central cavity and extending parallel therewith and wherein the wall surface defining the inner portion of each relatively narrow cavity, in planes normal to the blade or vane length, comprises lines which diverge symetrically about an axis normal to the blade or vane outer surface, at an included angle of more than 90°, towards the wall surface defining the outer portion of each relatively narrow cavity which outer portions approximate the blade or vane outer surface profile and wherein the relatively narrow cavities may comprise lines forming quasi triangular profiles in planes normal to the length of the blade or vane.

Alternatively the relatively narrow cavities may be defined by arcs of circles of appropriate, respective magnitude of radii in planes normal to the length of the blade or vane, so as to form quasi triangles.

The wall surface of the central cavity may be scalloped so as to approximate in form, the contours of the wall surfaces which define the inner portions of the narrow cavities.

The invention will now be described, by way of example and with reference to FIGS. 1 to 4 of the accompanying drawings in which.

Figure 1:
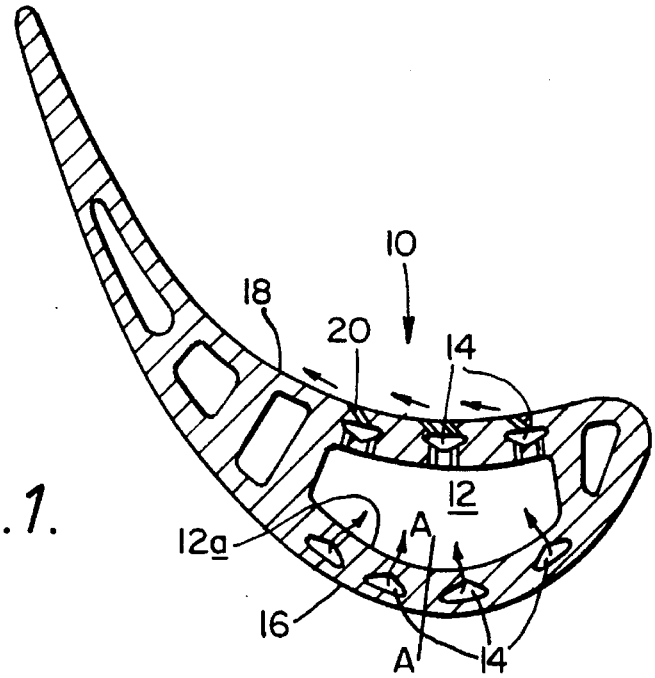
FIG. 1 is a cross sectional view of a blade in accordance with the present invention.

Referring to FIG. 1. A turbine blade 10 for a gas turbine engine (not shown) has a lengthwise extending, central cavity 12.

Further cavities 14 which are narrow relative to cavity 12, surround the cavity 12 and also extend lengthwise of the blade ie, substantially parallel with the cavity 12.

In operation, cooling air is forced up those narrow cavities 14 which are adjacent the suction surface 16 of the blade 10, from the vicinity of the root thereof (not shown). The cooling air thereafter passes into and across the central cavity 12, to exit the blade 10 on its pressure surface 18 via further cavities 14 and ports 20. The airflow as described herein, is depicted by the arrows.

It is seen from FIG. 1, that the suction surface 16 of the blade 10 experiences cooling only by way of conduction of heat inwardly to the adjacent wall surfaces of the narrow cavities 14. The adjacent wall surface 12*a* of the central cavity 12 however, is, relatively, subjected to a considerable contact with cooling air flow. Moreover, the narrow cavities

14 provide local cooled surface areas much closer to the pressure surface 16, than the wall surface 12*a* of the central cavity 12. There results planes containing for example, line 'AA' across which temperature gradients exist, which without utilisation of the present invention are sufficiently steep that, in conjunction with other operating stresses, may result in the cracking of the blade 10.

Figure 2:
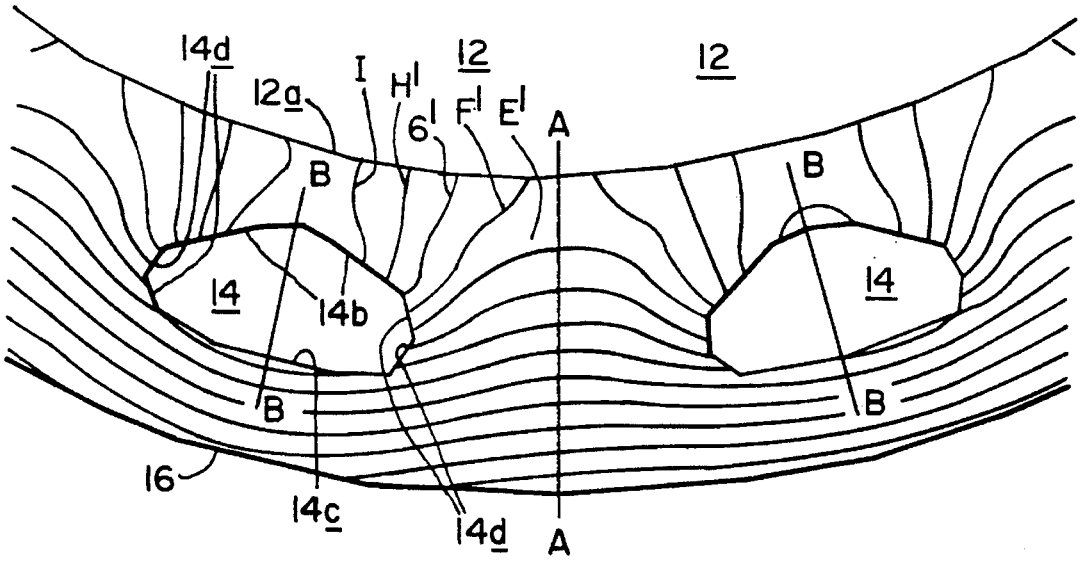
FIG. 2 is an enlarged part view of the blade of FIG. 1.

Referring now to FIG. 2. In accordance with a first embodiment of the present invention, those inner wall surfaces 14*b* of the narrow cavities 14 slope symetrically about a line 'BB' in a direction away from the wall surface 12*a* of the central cavity 12. The wall surface 14*c* of each narrow cavity 14 approximates the contour of the suction surface 16 of the blade 10. The surfaces 14*b* and 14*c* are joined at each end by boundaries 14*d* which define obtuse angles at their junctures, so as to maintain stress concentration at a minimum.

Figure 5:
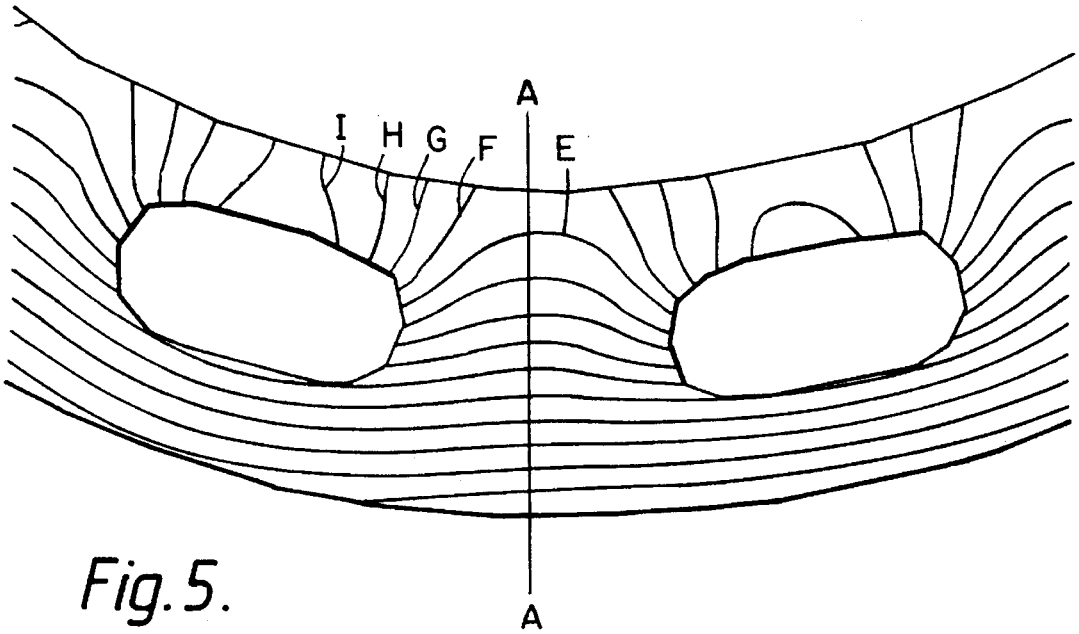
FIG. 5 depicts prior art.

When the arrangement of FIGS. 1 and 2 are compared with the prior art arrangement of FIG. 5, it is seen that the two former examples have more metal between the wall surfaces 14*b* and the wall surfaces 18 than has the latter example. The extra thickness reduces the cooling efficiency as is clearly indicated by the isothermic contours. Thus in comparative experiments, certain isothermic contours E, F, G, H and I in the relevent areas of the prior art example indicated certain temperature gradients, whereas corresponding isothermic contours E, F, G, H in FIG. 2 had less steep gradients. The stress reduction which is thus achieved in the FIG. 2 arrangement, more than compensates for the loss in cooling efficiency.

Figure 3:
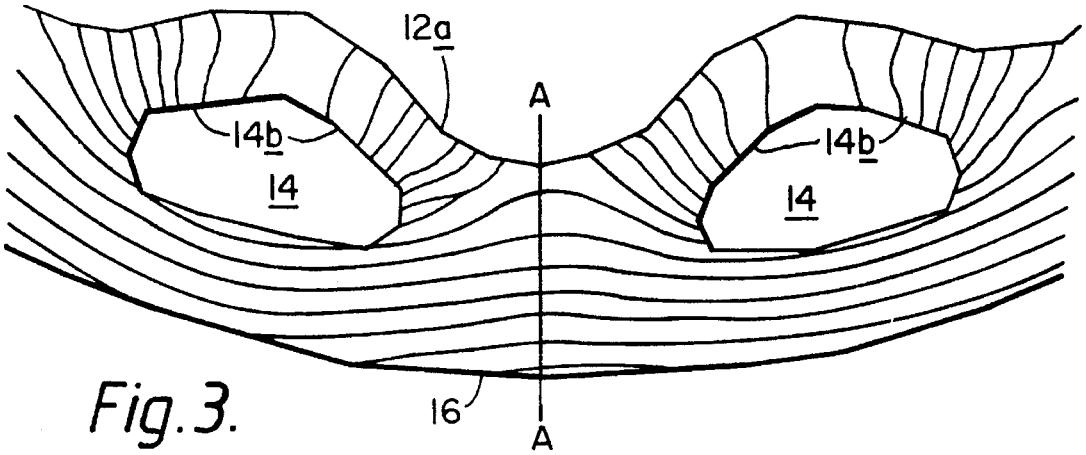
FIGS. 3 and 4 depict alternative embodiments of the present invention.

Referring to FIG. 3 in which like parts have like numerals. The FIG. 3 example differs from that of FIG. 2 in that the wall surface 18 of the central cavity 12 is scalloped, so as to approximate the contour of the wall suraces 14*b* of the narrow cavities 14. There results a necking effect between adjacent pairs of narrow cavities 14, which reduces the thickness of metal across which heat must pass from the suction surface 16, to the wall surface 18 of the cental cavity 12.

Consequently, heat which does traverse the reduced metal thickness, about the mean line 'AA' has not been dissipated to the extent shown in FIG. 2, and even less than as depicted in the prior art of FIG. 5.

A table is included hereinafter, to illustrate the small reduction in temperature which is achieved by both FIGS. 2 and 3, relative to the gradient of the prior art FIG. 5. It is seen that the FIG. 2 arrangement has a temperature drop along line 'AA' of 180° C., in FIG. 3 a still smaller drop of 140° C., whereas the prior art example as a temperature drop of 200° C.

| LINE 'AA' | FIG. 2 | FIG. 3 | FIG. 5 |
|---|---|---|---|
| SUCTION SURFACE 16 | X° c | X° c | X° c |
| WALL SURFACE 12a | Y° c | Y° c | Y° c |
| DIFFERENCE | X − Y = 180° c | X − Y = 140° c | X − Y = 200° c |

Figure 4:
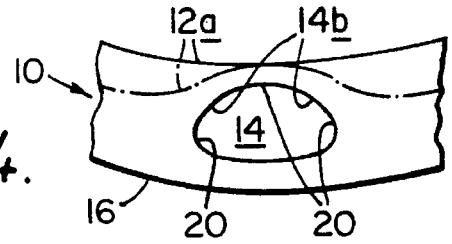

Referring to FIG. 4 in which again, like parts have like numerals. The narrow cavities 14 of which only one is shown, are defined by arcuate wall surfaces 14*b*, 14*c* rather than the straight wall surfaces 14*b*, 14*c* of FIGS. 1 to 3. The intersections of the main arcs are blended by the provision of arcs 20, of sufficiently small magnitude as to ensure that each wall surface 14*b* has a slope generally similar to the slope of each corresponding wall surface 14*b* in FIGS. 1 to 3. Similar heat transfer characteristics are thus achieved.

We claim:

1. An aerofoil member comprising a central cavity extending lengthwise of the aerofoil and further, relatively narrow cavities situated in the walls bounding said central cavity and extending parallel therewith and wherein the wall surface defining the inner portions of each relatively narrow cavity, in planes normal to the said member's length, comprises lines which diverge symmetrically about an axis normal to the member's outer surface, effectively at an included angle of more than 90° towards the wall surface defining the outer portion of each relatively narrow cavity, which outer portion approximates the member's outer surface profile, such that in combination, said lines and said outer wall portion comprise quasi triangular profiles in said planes normal to the length of the said member;

said relatively narrow cavities being defined in planes normal to the length of the said aerofoil member by arcs of circles of appropriate magnitude of radii as to form said quasi triangles, said wall surface of said central cavity being scalloped so as to approximate in form, the contours of the wall surfaces which define the inner portions of said narrow cavity.

2. An aerofoil member comprising a central cavity extending lengthwise of said member and a plurality of relatively narrow cavities situated in the walls bounding said central cavity and extending parallel therewith and wherein the wall surface defining the inner portions of each relatively narrow cavity comprise surfaces which diverge symmetrically about an axis normal to the member's outer surface, effectively at an included angle of more than 90° towards the wall surface defining the outer portion of each relatively narrow cavity, which outer portion approximates the member's outer surface profile, such that, in combination, said surfaces and said outer wall portions comprise quasi triangular profiles in said planes normal to the length of said member, said member having a pressure surface side and a suction surface side and at least some of said relatively narrow cavities being distributed along a portion of said pressure surface side, the outer portion of each of said at least some of said relatively narrow cavities being in flow communication with said pressure surface side of said member through relatively narrow passages which intersect said pressure surface side at an angle.

* * * * *